US006247777B1

(12) United States Patent
Shimoda

(10) Patent No.: US 6,247,777 B1
(45) **Date of Patent: *Jun. 19, 2001**

(54) RECORDING APPARATUS AND METHOD HAVING A TEMPERATURE OVERRISE PROTECTION FUNCTION

(75) Inventor: Junji Shimoda, Chigasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/508,537

(22) Filed: Jul. 28, 1995

(30) Foreign Application Priority Data

Jul. 29, 1994 (JP) ..... 6-179207

(51) Int. Cl.[7] ..... B41J 29/38
(52) U.S. Cl. ..... 347/14; 347/17
(58) Field of Search ..... 347/14, 17, 18, 347/19, 29

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,791,435 * | 12/1988 | Smith et al. | 346/140 |
| 5,166,699 | 11/1992 | Yano et al. | 346/1.1 |
| 5,367,325 * | 11/1994 | Yano et al. | 347/17 |
| 5,426,456 * | 6/1995 | Kuelzer et al. | 347/30 |
| 5,451,989 * | 9/1995 | Kadowski et al. | 347/18 |
| 5,477,245 * | 12/1995 | Fuse | 347/10 |
| 5,502,469 * | 3/1996 | Watanabe | 347/14 |
| 5,576,745 * | 11/1996 | Matsubara | 347/14 |
| 5,576,746 * | 11/1996 | Suzuki et al. | 347/14 |
| 5,650,808 * | 7/1997 | Vincent et al. | 347/43 |
| 5,940,094 | 8/1999 | Otsuka et al. | 347/17 |
| 5,956,052 * | 9/1999 | Udagawa et al. | 347/19 |

FOREIGN PATENT DOCUMENTS

| | | |
|---|---|---|
| 0419178 | 3/1991 | (EP) . |
| 0442705 | 8/1991 | (EP) . |
| 0496525 | 7/1992 | (EP) . |
| 0505154 | 9/1992 | (EP) . |
| 54-056847 | 5/1979 | (JP) . |
| 59-123670 | 7/1984 | (JP) . |
| 59-138461 | 8/1984 | (JP) . |
| 60-071260 | 4/1985 | (JP) . |

* cited by examiner

*Primary Examiner*—Christopher E. Mahoney
(74) *Attorney, Agent, or Firm*—Fitzpatrick, Cella, Harper & Scinto

(57) ABSTRACT

A recording apparatus and method are disclosed wherein when it is determined that an estimated temperature of an outer wall of a recording head is above a first predetermined temperature, a recording operation is stopped until the temperature falls below a second predetermined safe temperature.

15 Claims, 6 Drawing Sheets

RECORDING APPARATUS AND METHOD HAVING A TEMPERATURE OVERRISE PROTECTION FUNCTION

BACKGROUND OF THE INVENTION

1. Field of the Invention

The present invention relates to a recording apparatus and method, and more particularly to temperature control and an accompanying process, and, even more particularly, to temperature overrise protection in the recording apparatus.

2. Description of the Related Art

A recording apparatus used in a printer, a copying machine and a facsimile machine is constructed to record an image comprising a dot pattern on a recording medium such as a paper or a plastic thin sheet, in accordance with recording information. Such a recording apparatus may be classified by recording systems thereof into an ink jet system, wire dot system, thermal transfer system and laser beam system. Of those, the ink jet system recording apparatus discharges ink droplets (recording liquid) from discharge ports (outlets or orifices) provided in a head and deposits them to a recording medium to record an image. It has been widely used because it satisfactorily meets general requirements of high speed recording, high resolution recording, high grade recording and low noise recording.

As a general construction to meet the above requirements, a high head drive frequency and a large number of recording elements are used. In such a case, energy applied to the recording head remarkably increases.

Particularly, in the ink jet system, in which air bubbles are generated in ink by using thermal energy to discharge ink droplets, this tendency is remarkable. For example, in the recording apparatus, a member for mounting a recording head, an ink tank, and a member for supplying ink serve to emit heat by energy application, and when the drive frequency is doubled while a volume and a surface area of those members are kept fixed, a relatively double amount of energy would be applied. When the number of discharge ports is doubled, a double amount of energy would be applied, similarly. In actuality, when the number of recording elements or discharge ports is increased, a volume near the discharge ports increases but a volume of other parts and a surface area thereof do not significantly increase. Thus, in the above case, approximately four times the energy would be applied to the substantially constant volume and surface area In this case, for the ink jet system using thermal energy, several tens percent of the applied energy is emitted from recording head in the form of kinetic energy to discharge the ink and heat that is generated by the discharged ink. Thus, an approximately two-fold temperature rise is generated in the recording head by the application of four times the energy.

However, the temperature rise in such a recording head raises the following two problems.

A first problem is due to the fact that the temperature of the recording head becomes high due to the approximately two-fold temperature rise.

For example, when recording is done at a relatively high recording duty in a temperature environment of 30° C., a temperature in the apparatus rises approximately 10° C. by the temperature rise of a power supply, a motor and a driver in the recording apparatus. In this case, if a recording head with a relatively low drive frequency and a relatively small number of discharge ports is used, the temperature rise will be approximately 25° C. even for full painting or 100% duty recording, but when the drive frequency is doubled and the number of discharge ports of the recording head is doubled, the temperature rise will be double, that is, approximately 50° C. By summing the environment temperature and the temperature rises, the temperature of the recording head is approximately 65° C. for the low drive frequency and the small number of discharge ports while it is approximately 90° C. for the high drive frequency and the large number of discharge ports.

When the temperature of the recording head reaches approximately 90° C., failure of discharge is apt to occur. Further, in an apparatus in which the recording head is exchangeable or it may be touched by a user, it is necessary to pay attention to prevent the user from touching the recording head while the recording head is at a high temperature.

A second problem relates to a break mode of the recording head.

As explained above, the recording head temperature may reach 90° C. depending on the recording status. In this case, even if four times the energy is applied to the recording head, the temperature rise thereof is approximately two times because several tens percent of energy is ejected out of the recording head as thermal and kinetic energies when the ink is discharged. However, although the operation is that described above when the ink is normally discharged, the ink is not supplied to the recording head when an ink tank is empty and no ink to be discharged is present or when air bubbles stay in an ink supply path to block the supply of the ink. In such cases, a so-called empty heat state in which the recording head is driven without ink occurs.

In this case, since four times the energy is supplied with no ink discharged as in the above example, the energy for the discharge of the ink causes the abrupt rise of the temperature of the recording head so that the temperature of the recording head reaches one hundred and several tens ° C. As a result, plastic parts of the recording head exceed a thermal deformation temperature and they may be deformed, adhered portions may be torn off by the abrupt thermal expansion or the ink near the heater is burned making the heater inoperable.

The break mode which is inherent to the ink jet system is different from a break mode in the conventional thermal transfer system or wire dot system in which the temperature gently rises by continuous recording to cause breakage due to the temperature overrise determined by a heat capacity of the recording head unit. The existence of such a break mode makes difficult the solution by various countermeasures for the conventional break mode.

SUMMARY OF THE INVENTION

It is an object of the present invention to provide a recording apparatus and method which allows prevention of an abrupt overrise of temperature which leads to breakage of a recording head per se.

It is another object of the present invention to provide a recording apparatus and method which allows prevention of a user from touching a recording head which is at a high temperature.

In order to achieve the above objects, the present invention provides a recording apparatus for recording on a recording medium by using a recording head, comprising acquiring means for acquiring information on a temperature of an outer wall of said recording head; and control means for controlling an operation of said recording apparatus based on the temperature information of the outer wall acquired by said acquiring means.

Further, the present invention provides a recording method for recording on a recording medium by using a recording head, comprising the steps of acquiring information on a temperature of an outer wall of said recording head; and controlling an operation of said recording apparatus based on the temperature information of the outer wall acquired by said acquiring step.

In accordance with the present invention, when a temperature of an outer wall of a recording head reaches a high temperature such as a temperature which is dangerous if touched by a user, the recording operation is suspended until it reaches a safe temperature.

DETAILED DESCRIPTION OF THE PREFERRED EMBODIMENT

An embodiment of the present invention is now explained in detail.

Figure 1:
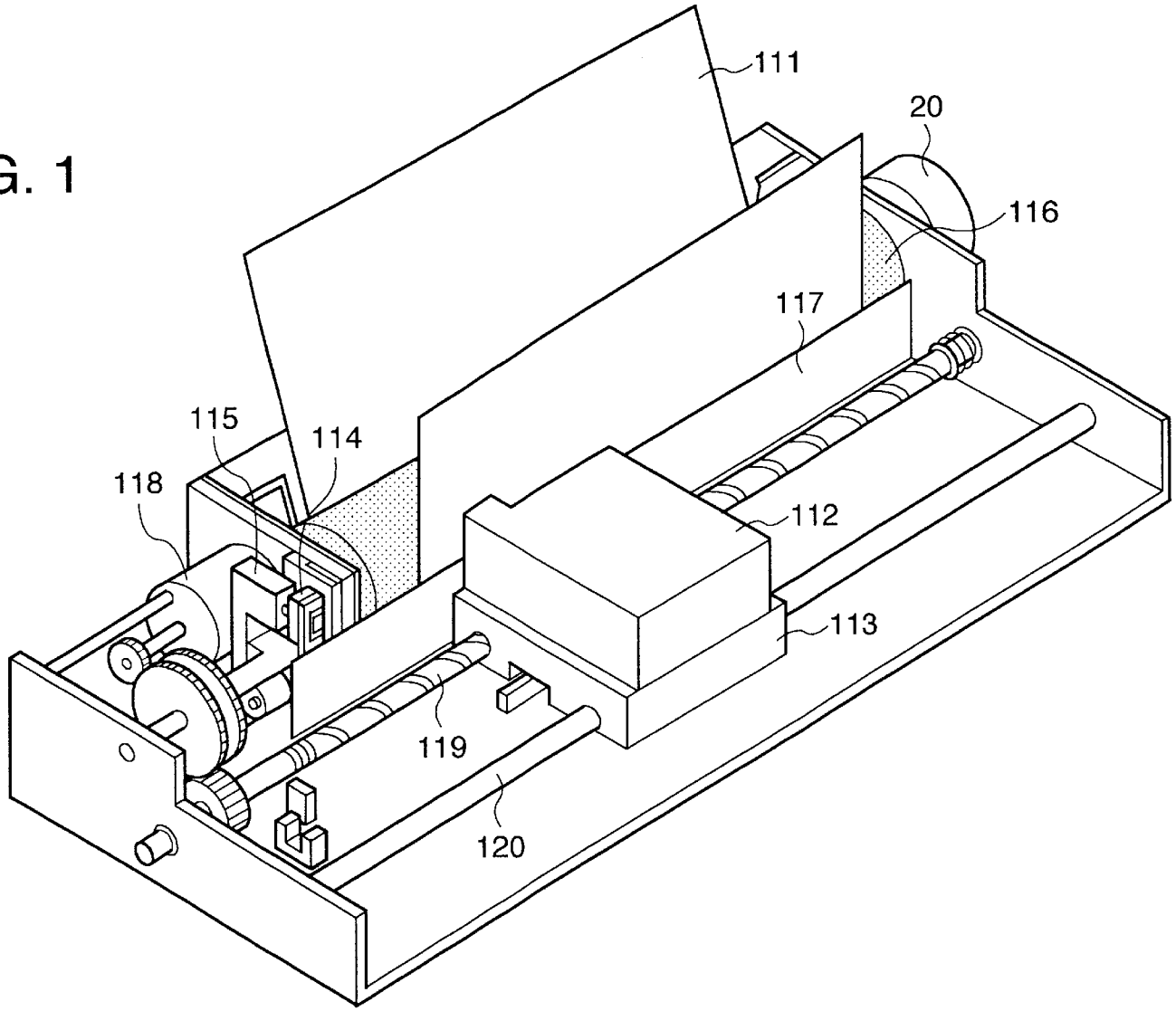
FIG. 1 shows a perspective view of an ink jet recording apparatus in accordance with one embodiment of the present invention.

FIG. 1 shows an outer perspective view of a printer as an ink jet recording apparatus in one embodiment of the present invention.

In FIG. 1, numeral 111 denotes a recording sheet on which a character image is to be printed. The recording sheet 111 inserted from the substantially top of the apparatus is fed invertedly by a sheet feed roller 116. The recording sheet has a recording plane thereof regulated to be planar by a sheet retainer 117. A recording head 112 discharges liquid droplets from a plurality of discharge ports onto the recording plane of the recording sheet 111 to form an image. Numeral 113 denotes a carriage for supporting the recording head 112 to scan it horizontally to the recording sheet 111 in forming the image. The movement thereof is effected by a lead screw 119 and guided by a guide shaft 120. Numeral 114 denotes a cap for sealing the discharge ports at the tip end of the recording head in a non-print state, and numeral 115 denotes a pump coupled to the cap 114 for sucking ink from the recording head 112. The lead screw and the suction pump are driven by a motor 118 as a motive force.

Figure 2:
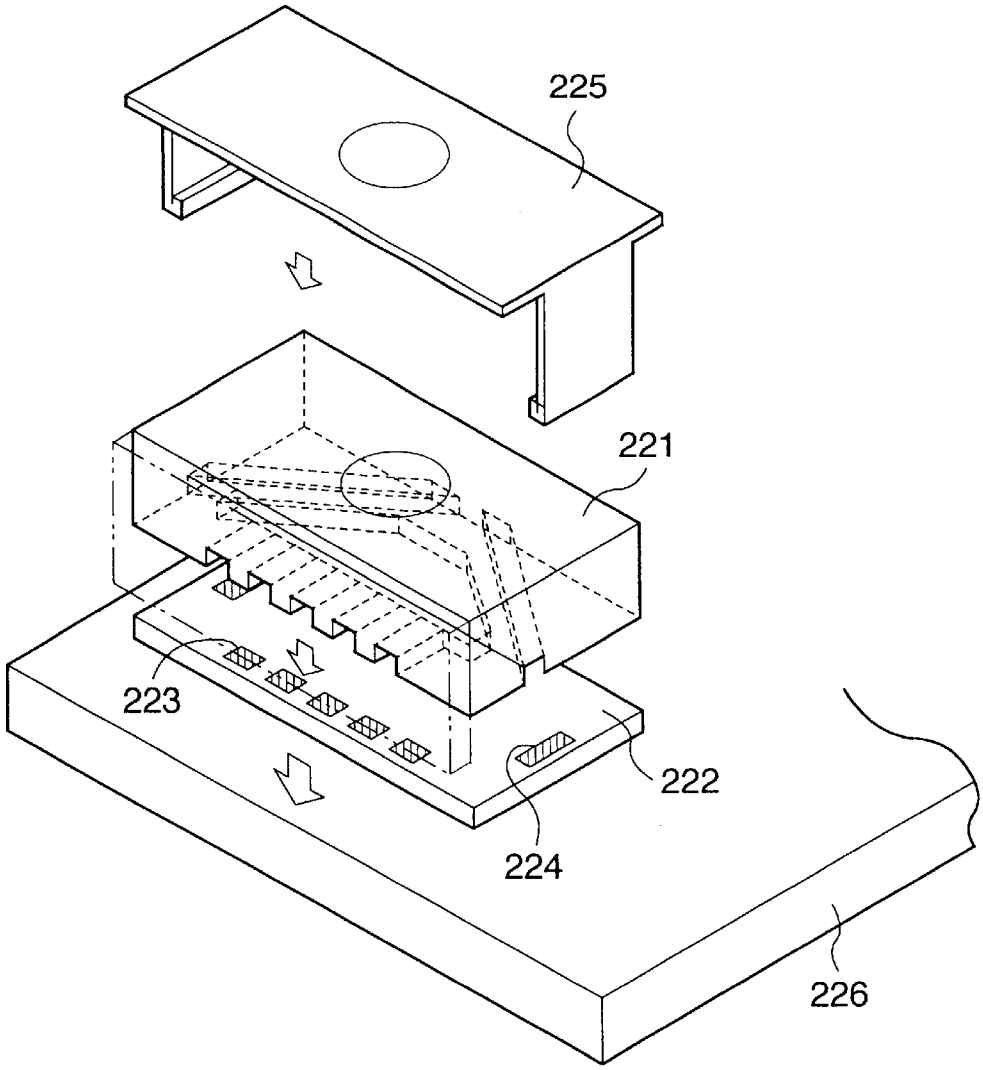
FIG. 2 shows an exploded perspective view of an internal structure of a recording head in the apparatus.

FIG. 2 shows an exploded perspective view of an internal structure of the recording head in the apparatus.

In FIG. 2, numeral 221 denotes a top plate having a plurality of liquid paths, a plurality of grooves for forming the discharge ports and a groove for a common liquid chamber that communicates with the liquid paths, and numeral 222 denotes a heater board having discharge heaters 223 corresponding to the liquid paths and a temperature sensor 224 formed thereon.

The top plate 221 and the heater board 222 are pressed onto a base plate 226 by a spring 225 so that they are fixedly joined together.

Figure 3:
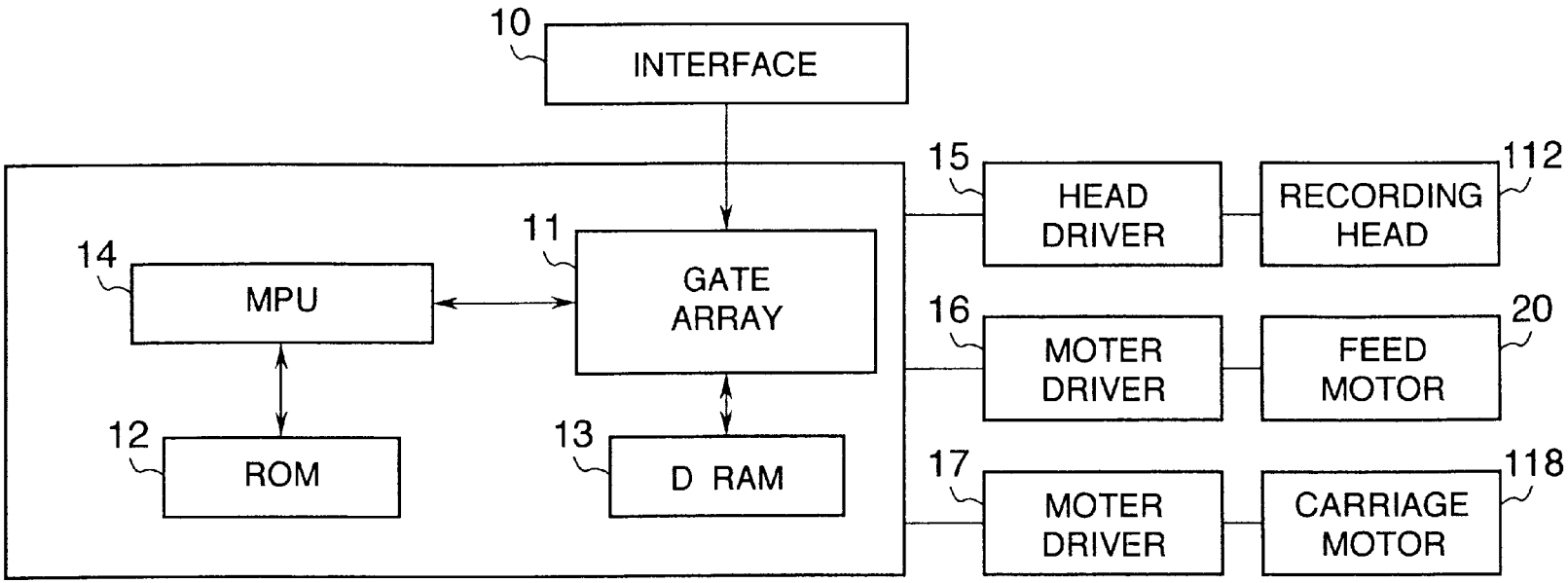
FIG. 3 shows a block diagram of a control unit of the apparatus.

FIG. 3 shows a block diagram of a control unit of the printer.

Respective elements in FIG. 3 are first explained. Numeral 10 denotes an interface, numeral 11 denotes a gate array, numeral 12 denotes a ROM, numeral 13 denotes a dynamic RAN (hereinafter referred to as DRAM), numeral 14 denotes an MPU for controlling the entire apparatus and processing data, numeral 15 denotes a head driver for driving the recording head 112, numeral 16 denotes a sheet feed motor drive for driving a motor 20, and numeral 17 denotes a motor driver for driving a carrier motor 118.

In the above arrangement, when recording data is sent from a host unit, not shown, through the interface 10, it is temporarily stored in the DRAM 13 by the gate array 11. The stored data is then converted from a form of raster data to a form of print image data to be recorded by the recording head 112, by the gate array 111, and again stored in the DRAM 13. The data stored in this form is transferred to the head driver 15 by the DMA transfer through the gate array 11 by a start of recording signal. Thus, the ink is selectively discharged from the discharge ports of the recording head 112 for recording.

Figure 4:
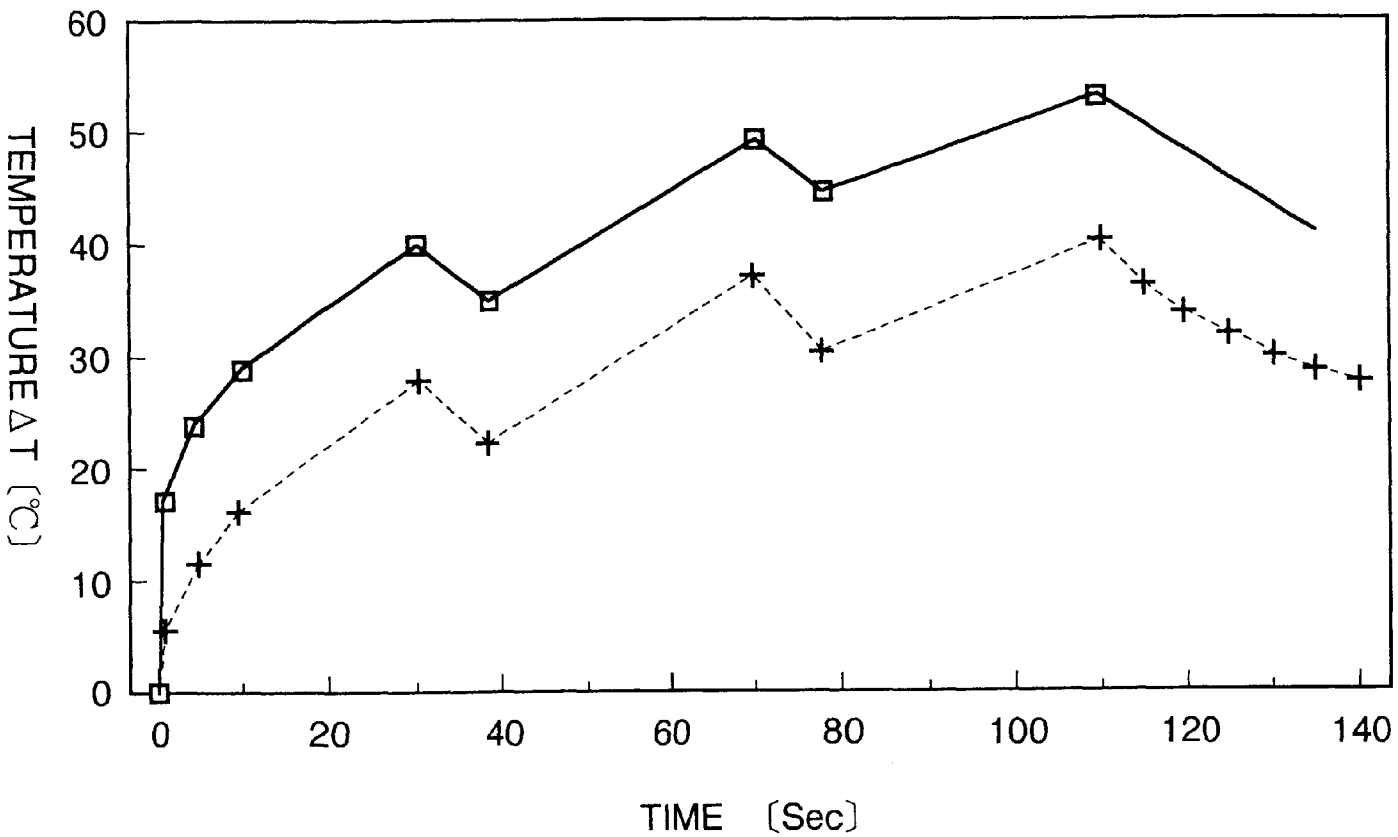
FIG. 4 illustrates a relation between a temperature detected by a temperature sensor of the recording head and a temperature of an outer wall of the recording head.

FIG. 4 shows a temperature rise in the continuous discharge from all of the discharge ports of the recording head 112.

In FIG. 4, an upper curve shows an output, converted to temperature, from the temperature sensor 224 in the heater board 222 when three size A4 cassette sheets are continuously printed, and a lower curve shows a surface temperature of the head outer wall, specifically the base plate 226.

As seen from FIG. 4, the surface temperature of the outer wall of the recording head 112 is correlated to the head temperature based on the output from the temperature sensor 224 in the heater board 222. Thus, the surface temperature of the outer wall may be estimated based on the output of the temperature sensor 224, and when the estimated temperature is above a predetermined temperature, the recording operation is stopped for a predetermined time interval or until the temperature of the outer wall falls below a predetermined temperature to control the temperature of the outer wall within a predetermined range.

Figure 5:
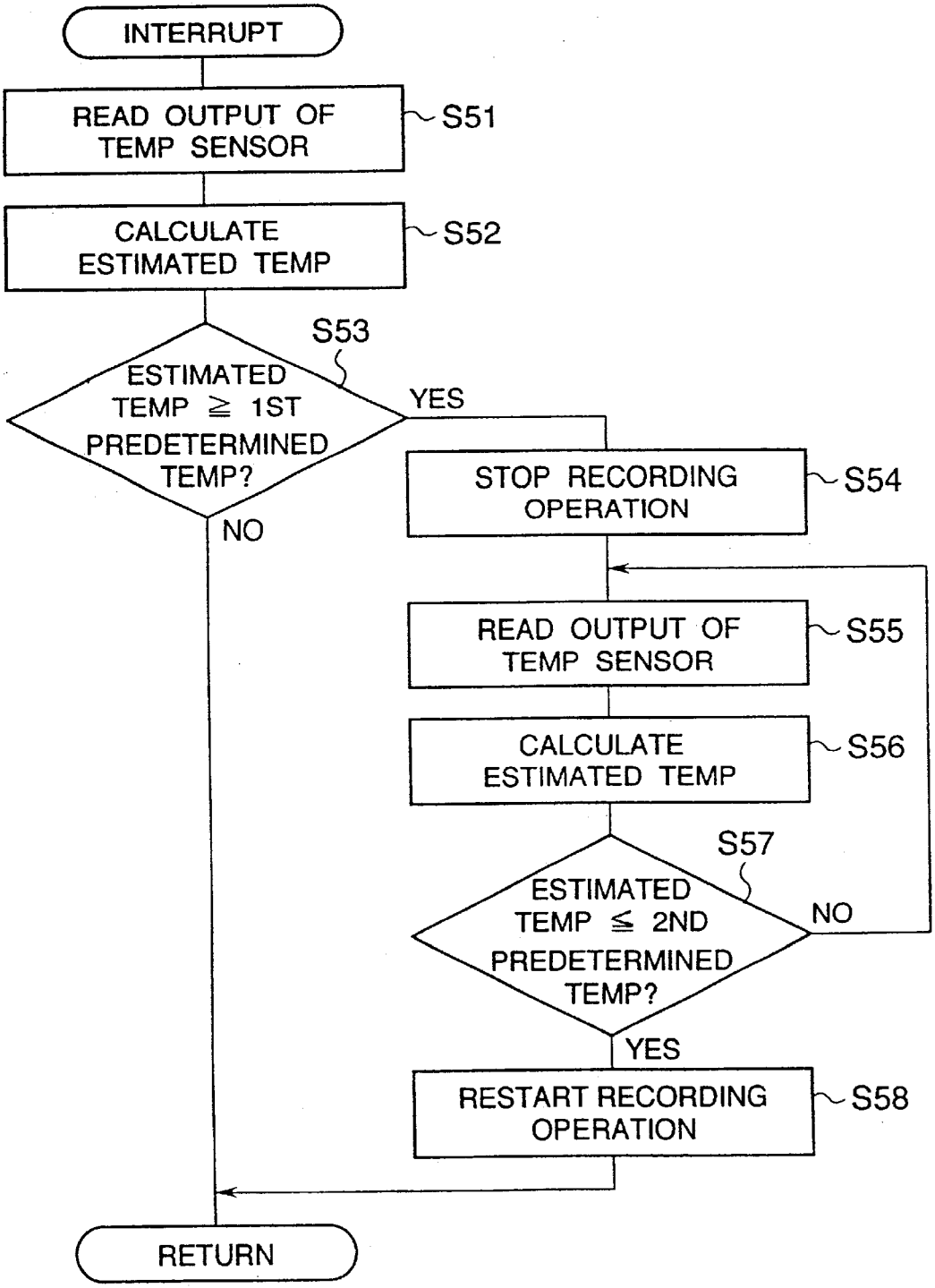
FIG. 5 shows a flow chart of a head temperature control process in embodiment of the present invention.

FIG. 5 shows a flow chart of a process of the temperature control.

In the illustrated process, it is started as a 10 msec interruption process. In a step S51, the output of the temperature sensor 224 (see FIG. 2) is read. In a step S52, the estimated temperature of the outer wall is calculated based on the output. In a step S53, whether the estimated temperature of the outer wall is higher than a first predetermined temperature, which is dangerous when a user touches it, or not is determined. If the decision is negative, the process is terminated.

In the step S53, if it is determined that the estimated temperature is above the first predetermined temperature, the process proceeds to a step S54 to stop the recording operation. Thereafter, the process waits until the estimated temperature of the outer wall falls a second predetermined temperature, which is lower than the first predetermined temperature (steps S55, S56 and S57). If "yes" in step S57, the stop of the recording operation is released in a step S58 and the process is terminated.

During the stop of the recording operation, the recording head 112 is returned to its home position and the pump is activated while the discharge plane is sealed by the cap 114 so that the ink in the recording head is sucked by the pump, and the heat in the head is dissipated together with the ink discharged by the suction to shorten the cooling time of the head.

Figure 6:
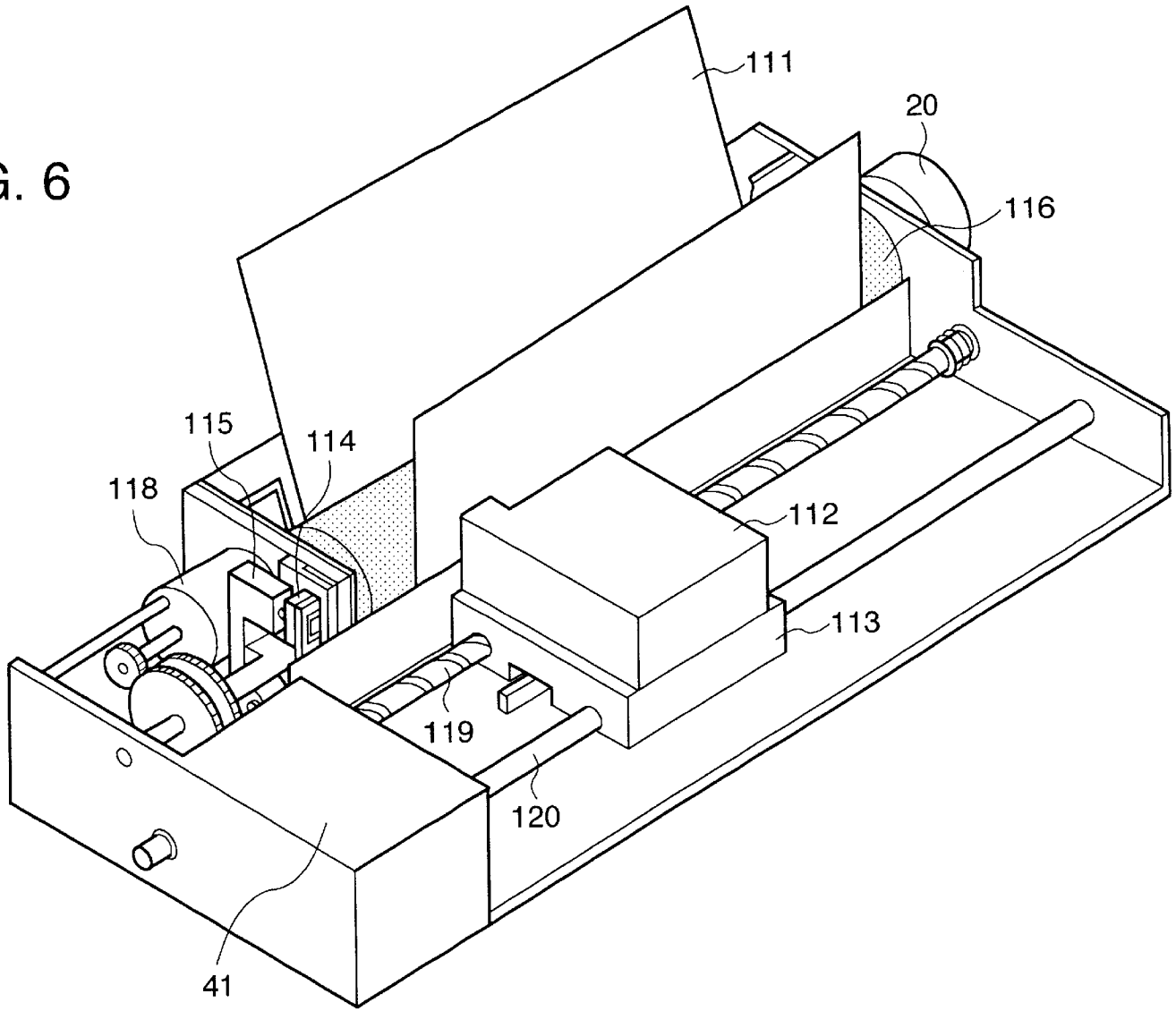
FIG. 6 shows a perspective view of the ink jet recording apparatus in accordance with another embodiment of the present invention.

FIG. 6 shows an outer perspective view of an ink jet recording apparatus similar to that shown in FIG. 1.

It differs from the apparatus of FIG. 1 in that a head cover 41 for preventing the removal of the recording head is provided at the home position. In the apparatus of FIG. 6, when the temperature of the head outer wall rises, the recording head is returned to the home position and the head stays under the head cover 41 until the temperature of the outer wall of the head falls below the predetermined temperature. Thus, the user is unable to remove the recording head because the head cover 41 covers it.

Further, at the end of the recording operation, if the temperature of the outer wall of the recording head is above the first predetermined temperature explained in FIGS. 4 and 5, the recording head 112 may be returned to the home position. The head then stays under the head cover 41 for the predetermined time interval or until the temperature of the head outer wall falls below the second predetermined temperature to inhibit the removal of the recording head.

The present invention is particularly suitable for use in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of a pulse because the development and the contraction of the bubbles can be effected instantaneously, and therefore the liquid (ink) is ejected with an fast response. The driving signal is preferably such as those disclosed in U.S. Pat. No. 4,463,359 and U.S. Pat. No. 4,345,262. In addition, the temperature rise rate of the heating surface is preferably such as those disclosed in U.S. Pat. No. 4,313,124.

The structure of the recording head may be those shown in U.S. Pat. No. 4,558,333 and U.S. Pat. No. 4,459,600 in which the heating portion is disposed at a bent portion, as well as the structure of the combination of the ejection outlet, liquid passage and the electro-thermal transducer disclosed in the above-mentioned patents.

In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port. This is because the present invention is effective to perform the recording with certainty and high efficiency irrespective of the type of the recording head.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provision of the recovery means and/or the auxiliary means for the preliminary operation are preferable because they further stabilize the effects of the present invention. As for such means, there are capping means for the recording head, cleaning means therefor, pressing or sucking means, preliminary heating means which may be an electro-thermal transducer, an additional heating element or a combination thereof. Also, means for effecting preliminary discharge (not for the recording) may stabilize the recording operation.

As regards the variation of the type of mountable recording head, it may be a single head for a single color or plural heads for a plurality of inks having different colors or densities. The present invention is effectively applicable to an apparatus having at least one of a monochromatic mode using mainly black, ink, a multi-color mode using different color inks and/or full color mode using a mixture of colors, which may be an integrally formed recording unit or a combination of a plurality of recording heads.

Furthermore, in the foregoing embodiment, the ink is liquid. Alternatively, ink which is solidified below room temperature and liquefied at room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. The present invention is applicable to other types of ink. In one of them, the temperature rise due to thermal energy is positively prevented by consuming it for the state change of the ink from the solid state to the liquid state. Other ink is solidified when it is left, to prevent the evaporation of the ink. In any case, the application of the recording signal produces thermal energy, the ink is liquefied, and the liquefied ink may be discharged. Other ink may start to be solidified at the time when it reaches the recording sheet.

The present invention is also applicable to the ink which is liquefied by the application of thermal energy. Such ink may be retained in a liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the inks described above is the film boiling system.

The ink jet recording apparatus may be used as an output terminal of an information processing apparatus such as a computer or the like, as a copying machine combined with an image reader or the like, or as a facsimile machine having information sending and receiving functions.

In accordance with the present invention, danger to the user is prevented and abnormal temperature rise which causes breakage of the recording head is also prevented.

While the invention has been described with reference to the structures disclosed herein, it is not confined to the details set forth and the present invention is intended to cover such modifications or changes as may come within the objects of the improvements or the scope of the claims.

What is claimed is:

1. A recording apparatus for recording on a recording medium by using a recording head, said recording apparatus comprising:

a temperature sensor provided within the recording head;

acquiring means for acquiring information relating to an estimated temperature of an outer wall of the recording head by estimation based on an output of said temperature sensor, the estimated temperature of the outer wall of the recording head being correlated to the output of the temperature sensor;

control means for suspending a recording operation of said recording apparatus when it is determined that the estimated temperature of the outer wall of the recording head is above a first predetermined temperature, based on the information acquired by said acquiring means, and resuming the recording operation after execution of a predetermined suspension operation; and an exchanging mechanism for exchanging the recording head, wherein said control means controls movement of the recording head to a predetermined waiting position where it is difficult for a user to touch the outer wall of the recording head during the predetermined suspension operation, wherein when the estimated temperature of the outer wall of the recording head is above the first predetermined temperature, said control means suspends the recording operation of said recording apparatus until the estimated temperature of the outer wall falls below a second predetermined temperature lower than the first predetermined temperature and resumes the recording operation after the estimated temperature of the outer wall falls below the second predetermined temperature, and wherein said control means inhibits the operation of said exchanging mechanism when the recording operation is suspended.

2. A recording apparatus according to claim 1, further comprising suction means for sucking ink, wherein the recording head discharges ink for recording, and said control means controls said suction means to suck the ink from discharge ports of the recording head when the recording operation is suspended.

3. A recording apparatus according to claim 2, wherein the recording head is covered by a cover member at the predetermined waiting position during the predetermined suspension operation.

4. A recording apparatus according to claim 1, wherein the recording head generates air bubbles in the ink by utilizing thermal energy and discharges the ink as the air bubbles are generated.

5. A recording apparatus according to claim 1, wherein the recording head is covered by a cover member at the predetermined waiting position during the predetermined suspension operation.

6. A recording apparatus according to claim 1, further comprising a carriage for mounting said recording head thereon.

7. A recording apparatus according to claim 1, wherein said recording apparatus is applied to a facsimile machine.

8. A recording apparatus according to claim 1, wherein said recording apparatus is applied to a copying machine.

9. A recording apparatus according to claim 1, wherein said recording apparatus is applied to a word processor.

10. A recording apparatus according to claim 1, wherein the recording operation is resumed after a predetermined time following suspension of the recording operation.

11. A recording method for recording on a recording medium by using a recording head in a recording apparatus, a temperature sensor being provided within the recording head, said method comprising the steps of:

acquiring information relating to an estimated temperature of an outer wall of the recording head by estimation based on an output of said temperature sensor, the estimated temperature of the outer wall of the recording head being correlated to the output of the temperature sensor;

suspending a recording operation of the recording apparatus when it is determined that the estimated temperature of the outer wall of the recording head is above a first predetermined temperature, based on the information acquired in said acquiring step, and resuming the recording operation after execution of a predetermined suspension operation; and moving the recording head to a predetermined waiting position where it is difficult for a user to touch the outer wall of the recording head during the predetermined suspension operation, wherein when the estimated temperature of the outer wall of the recording head is above the first predetermined temperature, the recording operation of the recording apparatus is suspended until the estimated temperature of the outer wall falls below a second predetermined temperature lower than the first predetermined temperature and the recording operation is resumed after the estimated temperature of the outer wall falls below the second predetermined temperature, and wherein said interrupting step inhibits an exchanging operation of the recording head when the recording operation is suspended.

12. A recording method according to claim 11, further comprising the step of sucking ink, wherein the recording head discharges ink for recording, and said interrupting step includes the sucking step to suck the ink from discharge ports of the recording head when the recording operation is suspended.

13. A recording method according to claim 12, wherein the recording head is covered with a cover member at the predetermined waiting position during the predetermined suspension operation.

14. A recording method according to claim 11, wherein the recording head is covered with a cover member at the predetermined waiting position during the predetermined suspension operation.

15. A recording method according to claim 11, wherein the recording operation is resumed after a predetermined time following suspension of the recording operation.

* * * * *

UNITED STATES PATENT AND TRADEMARK OFFICE

CERTIFICATE OF CORRECTION

PATENT NO. : 6,247,777 B1
DATED : June 19, 2001
INVENTOR(S) : Shimoda

It is certified that error appears in the above-identified patent and that said Letters Patent is hereby corrected as shown below:

Column 1,
Line 31, “Particularly,” should read -- Particularly --.
Line 47, “area” should read -- area. --.

Column 3,
Line 35, “EMBODIMENT” should read -- EMBODIMENTS --.

Column 4,
Line 9, “dynamic RAN” should read -- dynamic RAM --.

Column 5,
Line 51, “an” should read -- a --.

Column 6,
Line 27, “black, in,” should read -- black ink, --.

Signed and Sealed this

First Day of July, 2003

JAMES E. ROGAN
*Director of the United States Patent and Trademark Office*